United States Patent [19]

Fairbanks

[11] Patent Number: 4,582,109

[45] Date of Patent: Apr. 15, 1986

[54] ACCORDIAN FOLD TYPE DECORATIVE FABRIC DRAPERY SYSTEM

[75] Inventor: Lyman N. Fairbanks, Arlington, Va.

[73] Assignee: Custom Shade and Awning Corporation, Alexandria, Va.

[21] Appl. No.: 634,141

[22] Filed: Jul. 23, 1984

[51] Int. Cl.[4] ..... A47H 5/00

[52] U.S. Cl. ..... 160/84 R; 160/348; 160/DIG. 7; 160/DIG. 16

[58] Field of Search ..... 160/348, 349, 124, 84 R, 160/DIG. 16; 139/386

[56] References Cited

U.S. PATENT DOCUMENTS

| | | | |
|---|---|---|---|
| 1,254,339 | 1/1918 | Morgan | 139/386 X |
| 2,051,342 | 8/1936 | Nudelman et al. | 160/348 X |
| 2,609,043 | 9/1952 | Dubinsky | 160/124 |
| 2,859,810 | 11/1958 | Sachs | 160/124 |
| 3,155,150 | 11/1964 | Silvestre | 160/348 |
| 3,399,713 | 9/1968 | Wilson | 160/348 |
| 3,422,879 | 1/1969 | Ryan | 160/349 |
| 3,679,505 | 7/1972 | Hinderaker et al. | 160/DIG. 16 X |
| 4,188,991 | 2/1980 | Boyle | 160/348 X |

FOREIGN PATENT DOCUMENTS

| | | | |
|---|---|---|---|
| 2259570 | 8/1975 | France | 160/348 |

*Primary Examiner*—Ramon S. Britts
*Assistant Examiner*—David M. Purol
*Attorney, Agent, or Firm*—Mason, Fenwick & Lawrence

[57] ABSTRACT

An accordian fold type decorative fabric drapery system having a pair of drapery sections of decorative weave fabric sheets specially formed into sharply pleated accordian-like folds to provide a large number of vertically elongated narrow panels resembling in size the slats or louvers of a vertical blind system. Structure such as a decorative trim tape is secured at the top of each sheet having provision for convenient connection to slides in a conventional slide and trackway overhead drapery hand traverse rod system, and restraint straps secured to the drapery sections at alternate fold lines maintain the folds at a desired angle when the draperies are in extended position.

14 Claims, 6 Drawing Figures

23
25
25a
25b
25
24
21
20
26
18b
20a
19b
19
19c
19d
19a
18b
29
18b
30
27
28
15a
15b
15c
15d
15
27'

ACCORDIAN FOLD TYPE DECORATIVE FABRIC DRAPERY SYSTEM

BACKGROUND AND OBJECTS OF THE INVENTION

The present invention relates in general to drapery systems for interior decorative treatment of windows, transparent office or building partitions or dividers, and the like, and more particular to decorative fabric drapery systems resembling in appearance and usable in customary applications for vertical louver type blind or drapery systems and the like.

Vertical louver type blind systems, similar to venetian blinds in concept and operation, but formed of a large number of vertically extending elongated blind slats or louvers each pivoted about a vertical center axis for adjustment between open, closed, and desired intermediate positions, and slideable along upper and lower guide tracks have come into wide use as window blind systems, light transmission control or decorative control of transparent partitions or dividers in office space, and similar applications. More recently, decorative vertical blind systems of similar construction, but wherein the vertically elongated blind slats are hung from an upper channel track, channel moldings, drapery rod or the like, with the blinds in some cases covered with decorator fabric, have come into use.

The present invention is concerned with drapery systems creating a similar visual or interior decor impression as that created by decorator type vertical louver type blind systems for window or transparent partition treatment and the like, providing desirable interior decorator effects similar to those of decorator fabric type vertical louver type blind systems, but which can be drawn to closed or open positions in a manner similar to conventional draw type drapery systems and which provide interior decorator accent, fabric complementing, and similar interior decorative characteristics available from decorator fabric systems as well as louver type vertical blind systems at reduced cost and with effective light control.

An object of the present invention, therefore, is the provision of a novel accordian fold type decorative fabric drapery system having a pair of drapery sections of decorative weave fabric sheets specially formed into sharply pleated accordian-like folds to provide a large number of vertically elongated narrow panels resembling in size the slats or louvers of a vertical blind system, forming an accordian fold arrangement for each fabric sheet or drapery section with means such as a decorator trim tape secured at the top of each sheet having provision for convenient connection to slides in a conventional slide and trackway overhead drapery rod system, providing decorative fabric drapery effects similar to those attainable with louver type vertical blind systems and providing desirable characteristics of fabric drapery systems.

Other objects, advantages and capabilities of the present invention will become apparent from the following detailed description, taken in conjunction with the accompanying drawings illustrating a preferred embodiment of the invention.

DETAILED DESCRIPTION OF A PREFERRED EMBODIMENT

Figure 1:
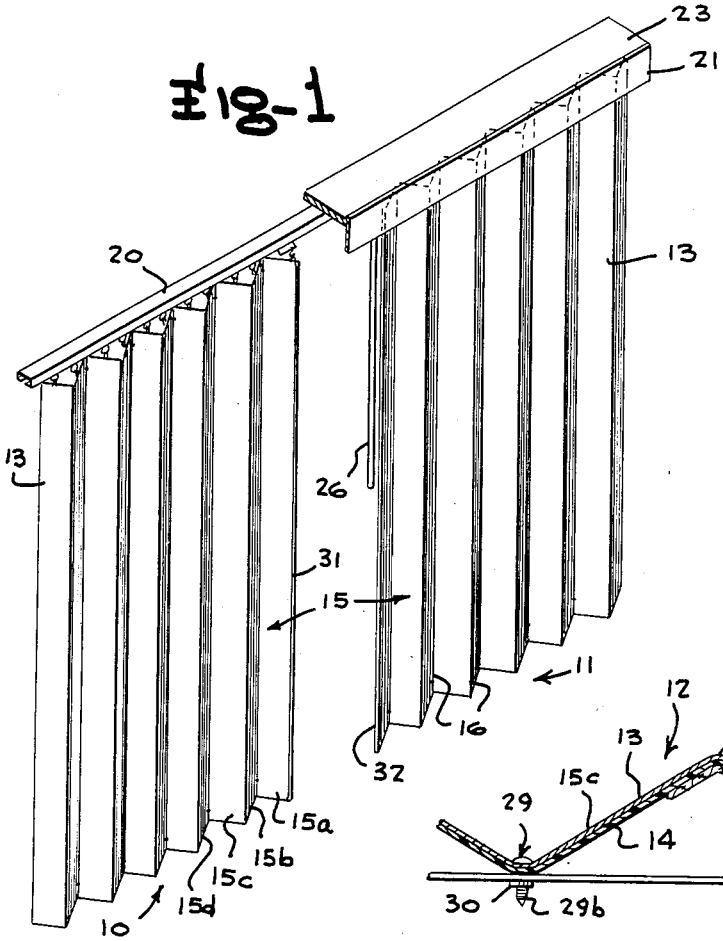
FIG. 1 is perspective view of the accordian fold type decorative fabric drapery assembly embodying the present invention.

Referring to the drawing, wherein like reference characters designate corresponding parts throughout the several figures, a preferred embodiment of the accordian fold type decorative fabric drapery system of the present invention is illustrated in FIGS. 1–5, and comprises a pair of drapery sections indicated by reference characters 10 and 11, of like construction, each formed in the illustrated embodiment as a laminated sheet, indicated generally by the reference character 12, formed of a decorative weave polyester fabric 13 providing the front or outer face of each drapery section, laminated to a vinyl laminate backing, indicated at 14, of a type and thickness customarily used as laminated backing for decorator drapery systems. The vinyl laminate backing 14 may either be of a suitable light opacity to achieve a desired amount of room darkening when the drapery system is drawn to closed position, or may have greater light transmissive qualities to provide a translucent effect.

Figure 4:
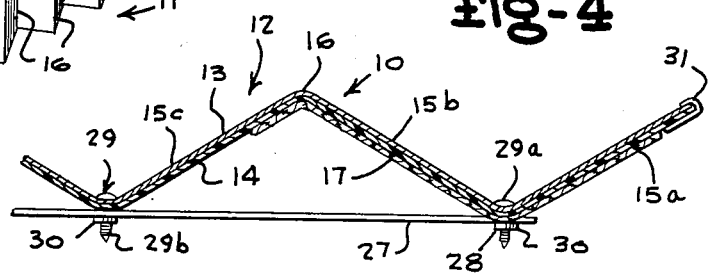
FIG. 4 is a fragmentary horizontal section view, taken along line 4–14 of FIG. 3.
Figure 3:
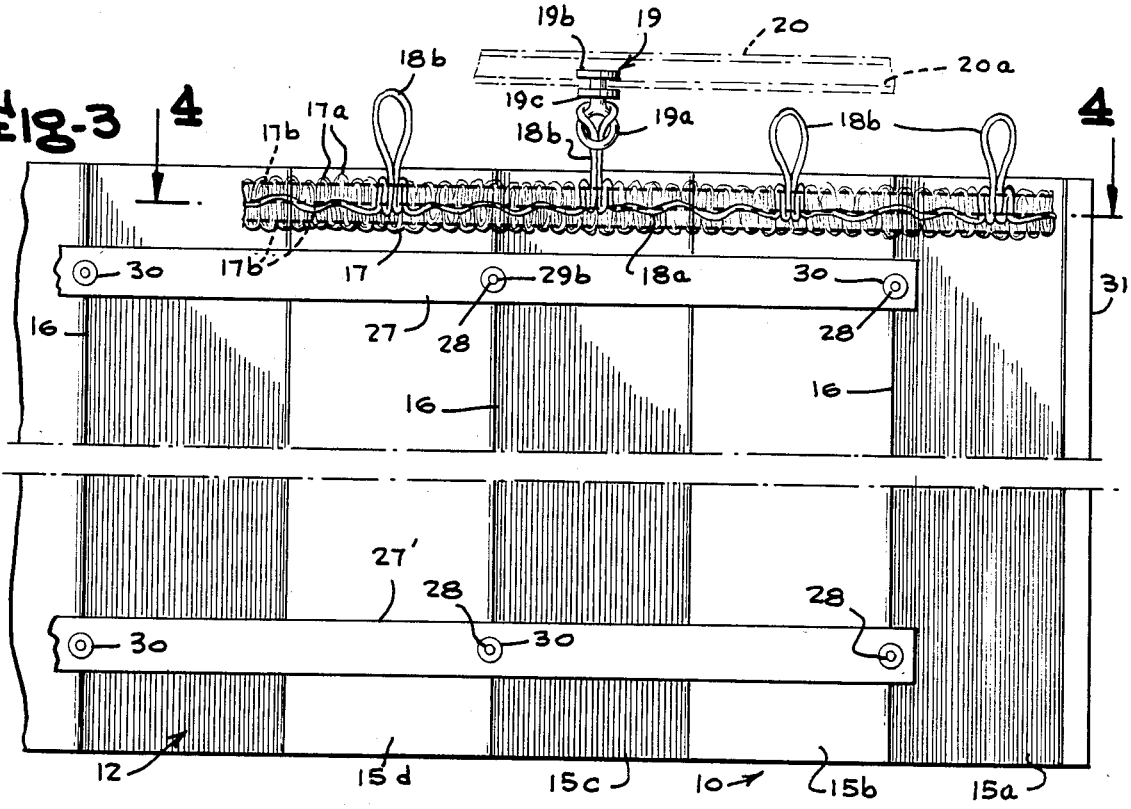
FIG. 3 is a fragmentary rear elevation view of the upper portion of part of one of the drapery sections over a plurality of pleated fold panels thereof showing the details of the decorative trim looped tape employed to provide the coupling loops for the slideable hanger members of a hand traverse rod track assembly.

To achieve the accordian fold arrangement providing the plurality of vertically elongated narrow panels, indicated generally at 15, some of which are designated for clarity as 15*a*, 15*b*, 15*c* and 15*d*, the decorative weave polyester fabric 13 is especially woven in a manner so that 3 or 4 vertically extending threads are left out at each of the fold lines, indicated generally at 16, throughout the full height of the fabric 13 from the top to the bottom of the drapery section, whereby a sharp fold or abrupt bend along a narrow hinge line is provided by the remaining threads extending horizontally or in directions transverse to the fold lines 16, co-active with the strengthening flexible vinyl laminate backing 14. To facilitate hanging of the drapery sections to the depending eye or ring end portions of the carrier slides of the overhead drapery rod slide and track assembly for example of the conventional type known as a hand traverse rod system, a special decorative trim tape, indicated at 17 is provided, similar to decorative headings and trimmings available for decorating drapery edges, valances, and the like, formed as shown in FIG. 4, of yarn arranged in closely adjacent looped or recurved folds, indicated at 17*a*, having a width in the vertical direction in the normal disposition as shown in FIG. 4 of about $\frac{5}{8}$ths inch, with three longitudinally extending binding threads indicated at 17*b*, including two threads fixing the positions of the tops and bottoms of the looped folds 17*a* and a center binding thread extends along the longitudinal center of the tape. Additionally, a projecting loop forming yarn indicated at 18*a* extends along a shallow serpentine-like path along the center longitudinal axis of the trim tape 17 and is shaped at appropriate longitudinal intervals to provide a projecting coupling loop, indicated at 18*b*, projecting for example about $\frac{3}{4}$ inch from the adjacent edge of the portion of the tape providing the folds 17*a*, and located longitudinally about every four inches along the length of the tape.

These projecting coupling loops 18*b* are to be coupled to the eye or ring like portion, for example as indicated at 19*a*, of the carrier slides 19, typically having enlarged head portions 19*b* and collar portions 19*c* at opposite ends of the shank portion 19*d*, which receives and supports the ring formation 19*a* and slides in the conventional channel-like trackway such as indicated at 20, for example having lower lip 20*a* flanking the bottom slot 20*b*. The channel-like trackway 20 may be secured against the underside of a top valance board or panel, or mounted at its opposite ends by conventional wall mounting brackets for hand traverse rod tracks, or may be mounted to a ceiling or the lintel of a window opening or door opening or partition frame.

For decorative effects, a valance strip, such as for example a valance strip of about one inch vertical dimension, of the same fabric pattern as the decorative weave polyester fabric 13, and indicated by the reference character 21, may be formed around the trackway system 20 and supported in any desired manner, for example by a horizontal top panel 23 to which the valance strip 21 is affixed.

Figure 2:
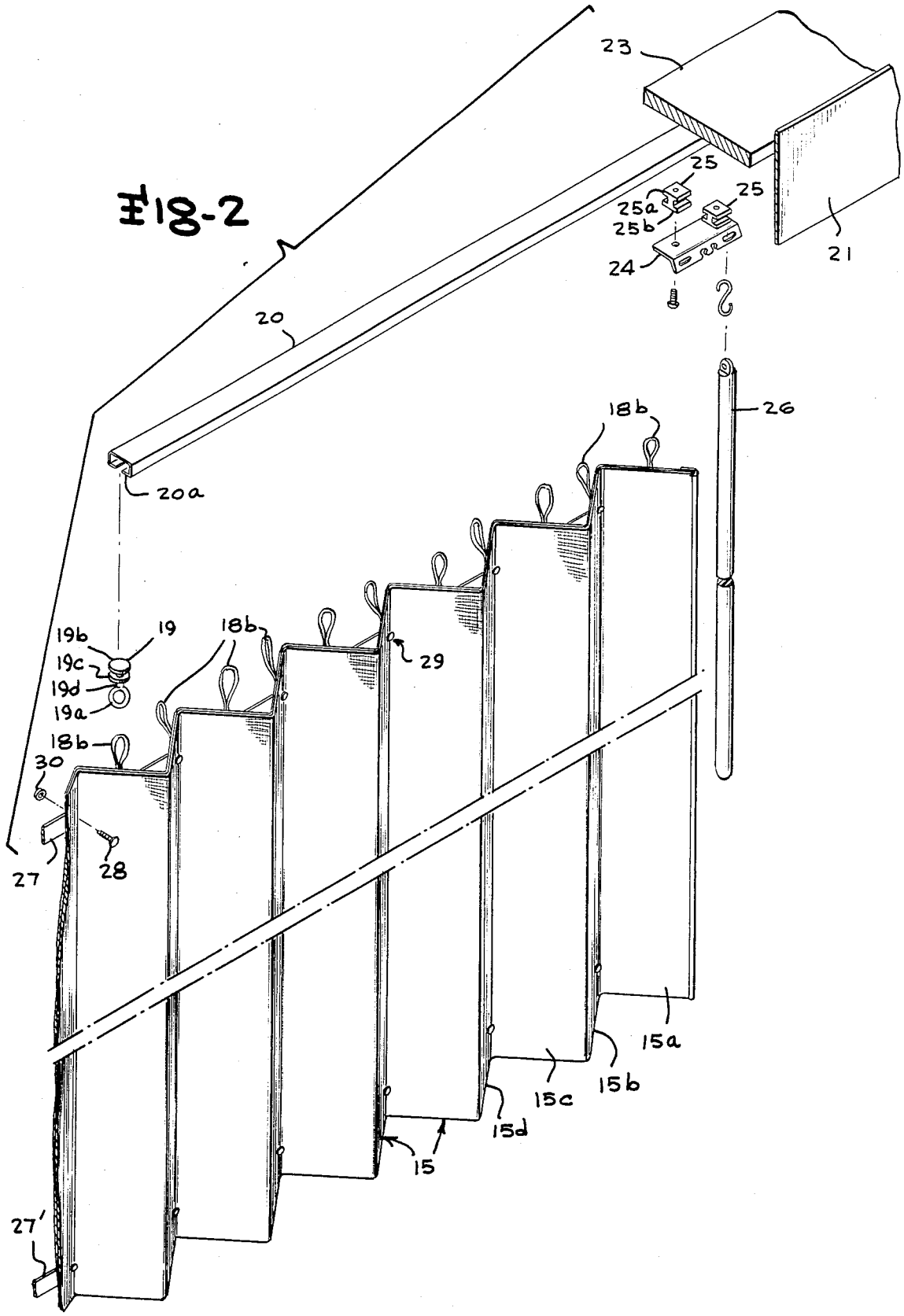
FIG. 2 is an exploded perspective view, to enlarged scale, of the upper portion of the drapery system showing portions of the channel and slide rod type supporting mechanism and the adjacent upper portions of one section of the accordian fold type drapery system.
Figure 5:
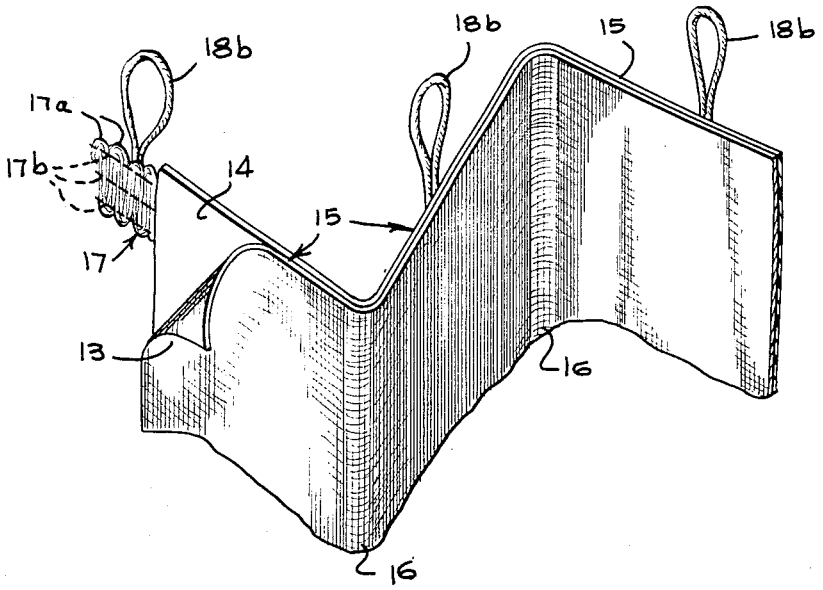
FIGS. 5 and 5A are fragmentary front perspective views, to a larger scale, of an upper portion of the drapery with parts broken away, for two different arrangements for connecting the fold panels to the slides of the slide and track road system.
Figure 5A:
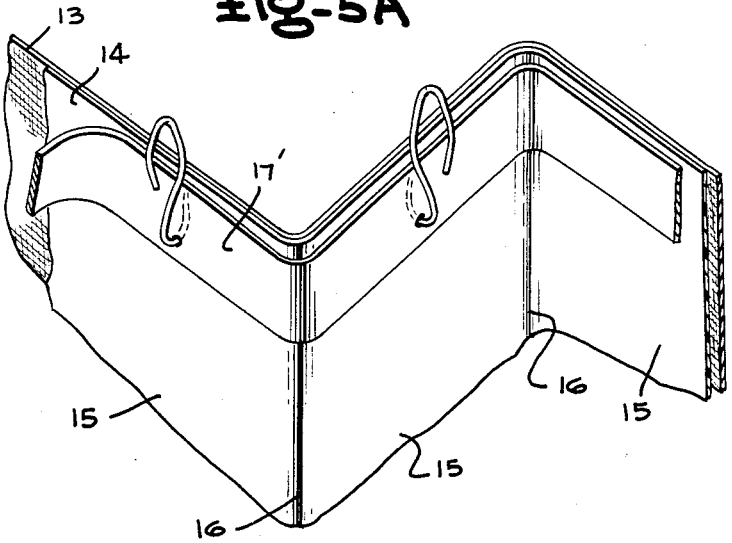

For a conventional hand drawn slide and track traverse rod system, a conventional center or moving end hardware fixture such as indicated at 24 in FIG. 2 may be employed at the upper ends of the center edges of the two drapery sections, supported by small plastic slide support members as indicated at 25 of substantially I-beam vertical cross section fixed at the lower ends by screw fasteners or the like to the horizontal leg 24*a* of the center slide fitting 24 with the upper and lower horizontal flange formations 25*a*, 25*b* embracing the lip 20*a* of the track 20. A rigid elongated operating rod 26 may be coupled to one of the openings of the vertical depending leg of the fixture 24 by an S hook or the like for manual sliding of the center edge portion of each drapery section to the desired position along the trackway.

To limit the extension of the accordian folds or panels 15 from being drawn to an approximately flat position in which the fold panels would disappear, but rather to maintain them in an attractive partially folded position when the drapery section is fully extended to cover the associated half of the window, doorway or similar opening, restraint strips 27 and 27' are provided, located approximately one inch below the upper edge and one inch above the lower edge of the panel sections, fastened at appropriate distances to every two successive fold line portions 16 at the rear of the drapery section by suitable plastic fasteners 28. These fasteners 28 may take the form of a plastic headed male fastener member 29 having a head such as shown at 29*a* and a shank 29*b* which is screw threaded or provided with a series of annular teeth along its length connective with a retainer female washer or nut member 30 which snaps or threads onto the shank portion 29*b* after the latter has been inserted through the fabric at the fold line 16 and inserted through the restraint strip 27 or 27' to limit the angle to which the adjacent folds can be drawn apart and thus restrain each drapery section in an attractive louver-resembling fold configuration in the extended position of the drapery. Of course, when the drapery section is drawn to the retracted position, the fold panels move to a tightly stacked position wherein the successive fold panels lie substantially flat against each other.

Additionally, a magnetic closure feature is provided, by installing from top to bottom along the center edge of each drapery a strip of magnetic strip material, such as the vinyl strips indicated at 31, 32, for example pressure sensitive magnetic vinyl strips such as No. 5913 ULTRAMAG produced by Magnets, Inc. of Cincinnati, Ohio, which attract each other and provide an even and tight closure eliminating gapping when the edges of the two drapery sections at the center of the drapery system are drawn to engage each other.

Alternatively, instead of using the special loop form of trim tapes such as indicated at 17, 18, a flat trim strip of any decorative design or a mere reinforcing binding tape strip or the like can be provided at the top edge portion of each drapery section, for example as indicated at 17', and the drapery sections can be coupled to the apertures or ring formations of the slides 19 by conventional drapery pins of the type customarily employed for pin hanging drapes to traverse rods and drapery rod systems.

I claim:

1. A decorative fabric drapery system forming draw drapes resembling louver type blinds arranged as a pair of drapery sections to be supported from slides of an overhead traverse rod system to be movable from extended closed position to retracted open position, the drapery sections each comprising an integral decorative weave fabric web of chosen drapery height having vertical threads and horizontal threads and pleat-like vertical fold lines defining vertically elongated accordian-fold flat planiform panels therebetween, each of said fold lines defined by a pair of adjacent vertical threads having a spacing therebetween which is substantially greater than the spacing between the remainder of the adjacent vertical threads in the fabric web, said fold lines extending throughout the height of the fabric web at spaced horizontal distances corresponding to a predetermined panel width resembling a predetermined width of blind slats of louver blinds, a thin laminate backing of vinyl-like material laminated to said decorative weave fabric web throughout the area of the web, top support means for the draperies including a tape member of elongated strip form secured to the upper edge portion of each drapery section along the length thereof and connecting means extending upwardly from said tape member at substantially a location midway between the fold lines at opposite edges of each accordian-fold panel for connection to and support by slides of a traverse rod system, and elongated restraint strap means connected to the joined fabric web and laminate backing of each respective drapery section at alternate fold lines spanning the drapery section horizontally with the connecting points thereof spaced less than the width of two panels to maintain the folds at predetermined partially folded relation when the drapery sections are in extended closed position.

2. A decorative fabric drapery system as defined in claim 1, wherein said tape member of said top support means is formed of a decorative trim tape having upwardly projecting yarn loops extending therefrom at spaced intervals spaced from each other to be located at the horizontal center of the respective accordian fold panels when the tape member is secured to the upper edge portion of the associated drapery section along the full length of the latter, such upwardly projecting loops being adapted to be looped through and about the pendant eye formations of conventional traverse rod slides for coupling the loops thereto.

3. A decorative fabric drapery system as defined in claim 2, wherein said decorative trim tape is formed of yarn arranged in closely adjacent recurved folds fixed in the recurved fold positions by longitudinally extending binding threads and having said upwardly projecting loops extending from the upper boundary of the adjacent recurved folds.

4. A decorative fabric drapery system as defined in claim 1, wherein said top support means comprises a tape member in the form of a fabric trim strip secured along its length to the joined fabric web and laminate backing of each respective drapery section and having conventional drapery hanging pins pinned thereto and providing upwardly extending hook formations to be coupled with apertures in the traverse rod slides.

5. A decorative fabric drapery system as defined in claim 1, having a pair of said elongated restraint strap means for each drapery section with one of such strap means being connection to the fold line portions near the upper edge of the associated drapery section and the other like restraint strap means connected to the alternate fold line portions near the bottom edge of the associated drapery section.

6. A decorative fabric drapery system as defined in claim 2, having a pair of said elongated restraint strap means for each drapery section with one of such strap means being connection to the fold line portions near the upper edge of the associated drapery section and the other like restraint strap means connected to the alternate fold line portions near the bottom edge of the associated drapery section.

7. A decorative fabric drapery system as defined in claim 3, having a pair of said elongated restraint strap means for each drapery section with one of such strap means being connection to the fold line portions near the upper edge of the associated drapery section and the other like restraint strap means connected to the alternate fold line portions near the bottom edge of the associated drapery section.

8. A decorative fabric drapery system as defined in claim 4, having a pair of said elongated restraint strap means for each drapery section with one of such strap means being connection to the fold line portions near the upper edge of the associated drapery section and the other like restraint strap means connected to the alternate fold line portions near the bottom edge of the associated drapery section.

9. A decorative fabric drapery system as defined in claim 1, wherein the inner vertical edge portions of the pair of drapery sections nearest each other are to be drawn into mutual abutment along their heighth when the drapery sections are in extended closed position and each includes a vertically elongated narrow strip of magnetic plastic material extending the heighth of the associated drapery section and joint thereto along said inner edge to be drawn into magnetically attracted tight abutment along the heighth of the drapery sections to eliminate gapping at said edges when the draperies are in said closed position.

10. A decorative fabric drapery system as defined in claim 2, wherein the inner vertical edge portions of the pair of drapery sections nearest each other are to be drawn into mutual abutment along their heighth when the drapery sections are in extended closed position and each includes a vertically elongated narrow strip of magnetic plastic material extending the heighth of the associated drapery section and joint thereto along said inner edge to be drawn into magnetically attracted tight abutment along the heighth of the drapery sections to eliminate gapping at said edges when the draperies are in said closed position.

11. A decorative fabric drapery system as defined in claim 3, wherein the inner vertical edge portions of the pair of drapery sections nearest each other are to be drawn into mutual abutment along their heighth when the drapery sections are in extended closed position and each includes a vertically elongated narrow strip of magnetic plastic material extending the heighth of the associated drapery section and joint thereto along said inner edge to be drawn into magnetically attracted tight abutment along the heighth of the drapery sections to eliminate gapping at said edges when the draperies are in said closed position.

12. A decorative fabric drapery system as defined in claim 4, wherein the inner vertical edge portions of the pair of drapery sections nearest each other are to be drawn into mutual abutment along their heighth when the drapery sections are in extended closed position and each includes a vertically elongated narrow strip of magnetic plastic material extending the heighth of the associated drapery section and joint thereto along said inner edge to be drawn into magnetically attracted tight abutment along the heighth of the drapery sections to eliminate gapping at said edges when the draperies are in said closed position.

13. A decorative fabric drapery system as defined in claim 5, wherein the inner vertical edge portions of the pair of drapery sections nearest each other are to be drawn into mutual abutment along their heighth when the drapery sections are in extended closed position and each includes a vertically elongated narrow strip of magnetic plastic material extending the heighth of the associated drapery section and joint thereto along said inner edge to be drawn into magnetically attracted tight abutment along the heighth of the drapery sections to eliminate gapping at said edges when the draperies are in said closed position.

14. A decorative fabric drapery system as defined in claim 2, wherein the inner vertical edge portions of the pair of drapery sections nearest each other are to be drawn into mutual abutment along their heighth when the drapery sections are in extended closed position and each includes a vertically elongated narrow strip of magnetic plastic material extending the heighth of the associated drapery section and joint thereto along said inner edge to be drawn into magnetically attracted tight abutment along the heighth of the drapery sections to eliminate gapping at said edges when the draperies are in said closed position.

* * * * *